United States Patent [19]

Klugar et al.

[11] Patent Number: 4,679,731

[45] Date of Patent: Jul. 14, 1987

[54] RAILWAY TRACK STRUCTURE AND A METHOD OF BUILDING SUCH STRUCTURE AND BAGS FILLED WITH BALLAST MATERIAL

[75] Inventors: Karl Klugar, Graz, Austria; Gerardus P. T. M. Van Santvoort, Elst, Netherlands

[73] Assignee: Akzo nv, Arnhem, Netherlands

[21] Appl. No.: 824,921

[22] Filed: Jan. 23, 1986

Related U.S. Application Data

[63] Continuation of Ser. No. 539,383, Oct. 6, 1983, abandoned.

[30] Foreign Application Priority Data

Oct. 6, 1982 [NL] Netherlands ..... 8203871

[51] Int. Cl.[4] ..... E01B 1/00

[52] U.S. Cl. ..... 238/2; 238/27; 405/229; 248/636; 53/469

[58] Field of Search ..... 238/1, 2, 27, 29, 30, 238/36, 45, 83, 105; 405/172, 157, 154, 229; 248/568, 636; 53/437, 469, 436

[56] References Cited

U.S. PATENT DOCUMENTS

| | | | |
|---|---|---|---|
| 1,353,210 | 9/1920 | Bates | 53/437 X |
| 1,743,824 | 1/1930 | Levine | 238/36 |
| 3,756,507 | 9/1973 | Hänig et al. | 238/2 |
| 4,311,273 | 1/1982 | Marsh . | |
| 4,368,844 | 1/1983 | Miller | 238/2 |

FOREIGN PATENT DOCUMENTS

| | | | |
|---|---|---|---|
| 1534039 | 1/1969 | Fed. Rep. of Germany . | |
| 1914712 | 10/1970 | Fed. Rep. of Germany . | |
| 2105231 | 9/1971 | France . | |
| 153406 | 12/1979 | Japan | 238/2 |
| 624982 | 9/1978 | U.S.S.R. | 238/2 |

*Primary Examiner*—Randolph A. Reese
*Assistant Examiner*—Glenn B. Foster
*Attorney, Agent, or Firm*—Stevens, Davis, Miller & Mosher

[57] ABSTRACT

The invention relates to a railway track structure of which the rails are fastened to sleepers. Under each sleeper there are provided one or more bags filled with ballast material in the form of pebbles, broken stone and/or sand. The invention also comprises a method of building such a railway track structure.

22 Claims, 5 Drawing Figures

RAILWAY TRACK STRUCTURE AND A METHOD OF BUILDING SUCH STRUCTURE AND BAGS FILLED WITH BALLAST MATERIAL

This application is a continuation of application Ser. No. 539,383, filed Oct. 6, 1983, now abandoned.

The invention relates to a railway track structure formed of at least a pair of rails which are fastened to sleepers via which they are supported on a bed of ballast material.

Railway track structures of the type indicated above are generally known. Although these known railroad structures are found to be quite satisfactory, their proper functioning is not quite so easy to keep up. Particularly a conventional railroad structure with a ballast bed entirely formed of broken stone or pebbles requires rather a great deal of maintenance. Especially the practically cohesionless supporting layer rapidly pulverizes to a greater or lesser extent under the influence of the dynamic load.

Moreover, of existing or newly laid railway tracks the transport capacity is often to be increased, which can be realized with heavier and more frequent trains per day that generally attain higher speeds. Said increase in transport capacity will lead to higher and heavier loads being applied to the railway track in its entirety and to its individual components, an important role being played by the dynamic load. In the case of heavy traffic schedules conventional track maintenance is no longer possible during the day, so that the work must be done at night. Operation of the heavy duty ballast tampers and ballast consolidating machines is very slow and is attended with a high noise level. People living near a track under maintenance may raise objections and environmental problems may arise. Moreover, on railway track sections which frequently carry bulk material or in deserts the ballast bed material, which generally has a diameter of 30 to 60 mm, becomes fouled up with this bulk material or sand, which also detracts from the proper functioning of the ballast bed. As far as the maintenance of these conventionally built railroad structures is concerned, the high demands made on it these days can be met only with great difficulty and generally at prohibitively high cost.

The invention has for its object to provide a railway track structure of the type indicated in the opening paragraph which no longer shows the afore-mentioned disadvantages. According to the invention the railway track structure is characterized in that beneath the sleepers there are provided one or more supporting elements filled with ballast material and preferably having a flexible wall, such as bags or the like. According to the invention the bags are closed and made of a water-permeable material, more particularly a woven fabric of synthetic yarns, such as those of polyester, polyamide or polypropylene. According to the invention the ballast may optionally be contained in metal netting.

According to the invention the tenacity of the fabric is in the range of from 90 to 150 kN/m, preferably about 120 kN/m, and the bags are each covered internally and/or externally with a web of non-woven material. An effective embodiment is characterized according to the invention in that the bags extending in longitudinal direction of the sleepers are each fastened to the sleepers with one or more straps. These straps may be fitted with clamp coupling, which may optionally be readjustable. The resistance of the ballast bed to dynamic load and deformation will be favourably influenced if according to the invention the closed bags filled with ballast material are under tension. This tension ensures that the ballast material in the bag will hold together. The ballast material may be made up of various grades of pebble, crushed stone, pebble-sand mixtures or some other material of sufficient strength. To stabilize elasticity elastic components may be added to the ballast material. Optionally, a bladder of some synthetic material may be placed in the bag near the closure and inflated with compressed air after tying up the bag. To this end also use may be made of waste products that are sufficiently elastic.

A simple embodiment of the railway track structure according to the invention is characterized in that beneath each sleeper there are positioned two bags filled with ballast material. The two bags are advantageously so positioned beneath the sleepers that halfway between the two rails the two facing ends of the bags are spaced at some distance apart. Said space is filled with ballast material or the like.

A particularly effective embodiment according to the invention is characterized in that the sleepers are each positioned within the upper part of a bag. This provision has the advantage that the bags need not be fastened to the sleepers with straps. Instead of employing a solid wooden sleeper use may with advantage be made of a steel tube having a rectangular cross-section.

Favourable results may in principle also be obtained with the bags extending beneath the sleepers in longitudinal direction of the rails.

According to the invention the bags may be filled with some hard ballast material such as pebbles, broken stone, sand and/or slag. Favourable results are also expected if according to the invention the bags are filled with a mixture of hard ballast material, such as pebbles, broken stone and/or sand, and elastic material, such as pieces of elastomeric material.

A favourable embodiment of the railway track structure according to the invention is characterized in that measured over their side resting on the subsoil, the filled bags extending in longitudinal direction of the sleepers have a length of about 140 to 180 cm, preferably about 150 cm, and their greatest transverse dimension in longitudinal direction of the rails is about 40–70 cm, preferably about 60 cm.

It is expected that a railway track structure comprising ballast bags according to the invention will not require any maintenance for many years as far as the ballast bed is concerned. The bags are so porous that air and water will have access to the contents of the bags. The filled bags have a greater width than the sleepers, as a result of which the ballast bed will have a high load bearing capacity and the load is uniformly distributed. The ballast bed according to the invention is also expected to be of satisfactory use in desert-like regions with blowing sand. As a matter of fact, a conventional ballast bed is made impermeable to water by all the sand and loses its elasticity in that fine sand particles will deposit in the ballast bed.

The invention also comprises a method of building a railway track structure by which a bed of ballast material with sleepers and rails is provided, which is characterized according to the invention in that beneath the sleepers there are placed one or more bags or like containers filled with ballast material. The bags may with advantage be fastened to the sleepers with straps that may be provided with clamp couplings. A favourable embodiment of the method according to the invention is characterized in that in the bag filled with ballast material this material is set into vibration in order that it may be compacted before the bag is closed. It is preferred that the ballast material is set into vibration at a frequency and at an amplitude such that the ballast material behaves practically like a liquid, and the bag is closed while the ballast material in it is in vibratory motion or afterwards. In that way the filling of the bags with ballast material will be optimal, with the cloth material of the filled bags being tensioned. When the bags thus filled are fastened beneath the sleepers, the bags are somewhat pre-tensioned. Because of this pre-tension the bags will be more capable of taking up the high dynamic loads applied to the track due to the traffic thereover of trains. A favourable embodiment of the method according to the invention is characterized in that the bag, after it has successively been filled with ballast material and closed, is so compressed by pre-tension transverse to its longitudinal direction that two opposed flattened faces are formed. For protection, the bags placed on their supports may be covered with ballast material.

Laying a railway track according to the invention may be simplified by prefabricating a group of sleepers, say 4–6, with bags filled with ballast material fastened to them and collectively fastening the whole construction to a carrier, such as a mounting rail, after which the carrier with sleepers and bags is transported to the site for laying the railway track.

The invention also comprises a bag-shaped body formed by a flexible container filled with ballast material, which body is formed in the manner described hereinbefore for use in the railway track according to the invention.

The invention also comprises a foundation for a railway, a building structure, a machine, a road or some other construction, which is characterized in that said foundation contains a plurality of the aforedescribed bag-shaped bodies according to the invention.

A model construction of bags for a railway track structure according to the invention has been subjected to $24.2\times10^6$ load variations on a ballast bed simulator. A series of $4\times10^6$ load variations was in the range of 0–90 kN, which in actual practice corresponds to an axle load of 360 kN. Such a load pattern must be reckoned to occur under extremely severe service conditions. The test results show that the bags are and remain in good condition. From the beginning to the end of the experiment (24.2 million load variations) the elastic deformation reamins at a constant value, which is considered very favourable. The settling pattern of the bag construction, the bags being filled with rounded material, is equal to and just as little as that of a traditional ballast bed of broken material.

The invention will be further described with reference to the accompanying schematic drawing.

Figure 1:
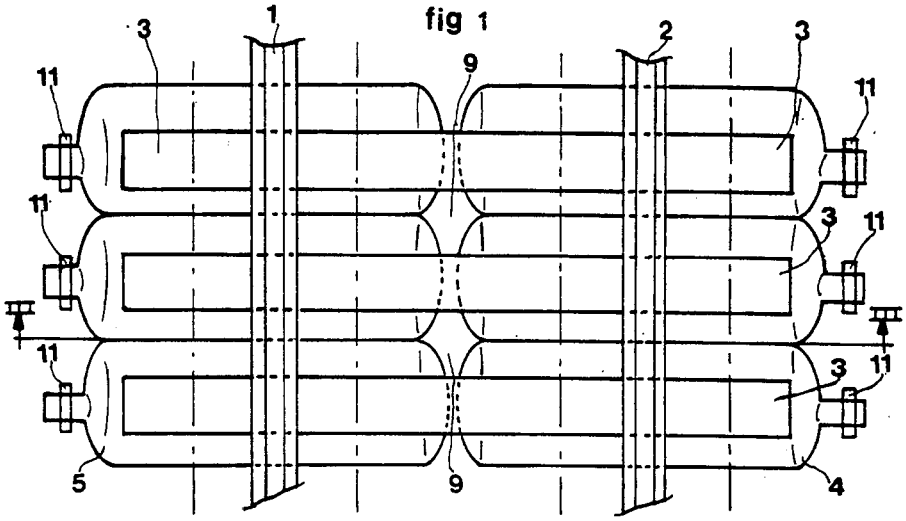
FIG. 1 is a plan view of a railway track structure according to the invention.
Figure 2:
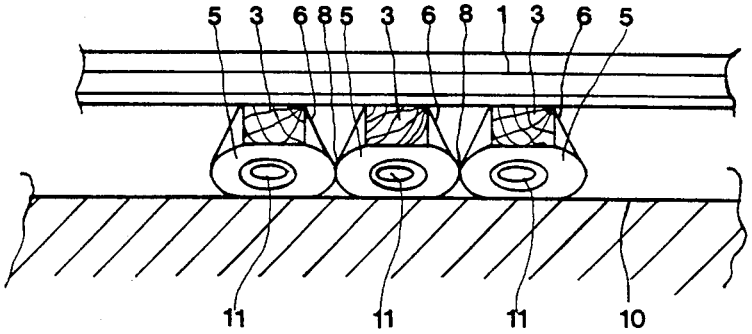
FIG. 2 shows a railway track structure in a side view.
Figure 3:
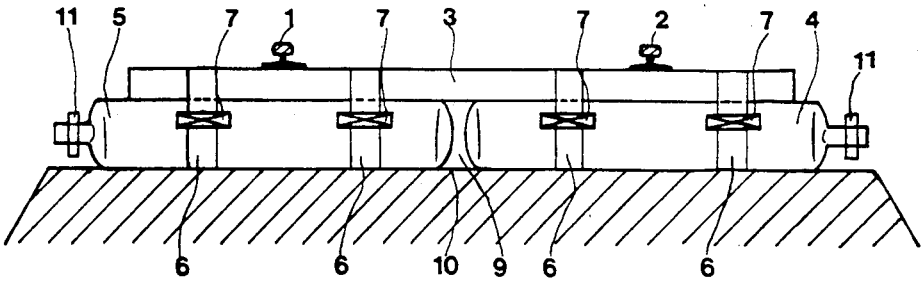
FIG. 3 is a side view of the railway track structure along the line III—III transverse to rails.

FIGS. 1–3 illustrate a single track of which the rails are referred to by the numerals 1 and 2 and the sleepers spaced at about 60 cm centres apart by the numeral 3. Beneath each conventional wooden or concrete sleeper 3 are two bags 4 and 5 filled with ballast material such as course gravel or rubble. Each sleeper 3 is fastened to each of the bags 4 and 5 with two straps 6. Fastening to the bags 4 and 5 is effected with the aid of optionally re-adjustable clamp couplings 7. The rails 1,2 are fastened to the sleepers 3 in a conventional manner, which is not shown. The bags, which succeed each other in longitudinal direction of the rails, touch on their sides at the points 8. Alternatively, however, small some small space may be left between the sides of the bags. As the two facing ends of the bags 4,5 beneath each sleeper 3 do not touch, some free space 9 is left in the centre of the track, halfway between the two rails 1,2, which space is not filled with ballast material, which is not shown in the drawing. The subsoil 10 supporting the bags 4,5 may be of the same kind as that of the ballast bed of a conventional railway track.

In view of the magnitude of the loads applied to the track structure by the trains moving thereover the bags 4,5 are of a synthetic fabric having a tenacity in the order of 120 kN/m. On the one hand the fabric must be properly permeable to water, but on the other hand it must be substantially impermeable to sand. Each bag is closed at its outwardly facing end with a strap 11.

Figure 4:
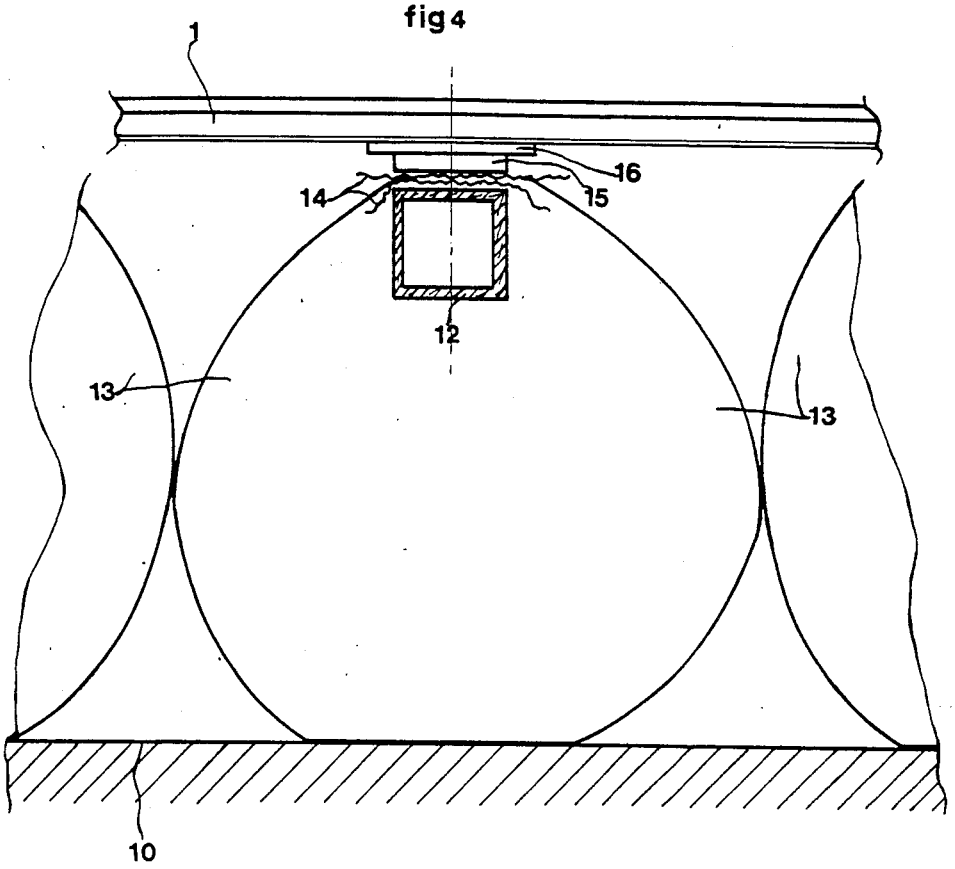
FIG. 4 is a sectional and elevational view of an embodiment in which the sleepers are positioned inside the bags.

FIG. 4 is a schematic illustration of an embodiment according to the invention in which the sleepers 12 are each positioned inside a bag 13 filled with ballast material (not shown). With this embodiment the sleepers 12 are steel tubes that have a square cross-section and are positioned inside the upper part of the bag as represented in the drawing. To prevent damage to the bags 13 protective material 14 is provided on the upperside of the sleepers both on the inside and the outside of the bag. On top of the protective material are two load distribution plates 15 and 16 on which there is placed the rail 1, which is suitably fastened (in a manner not shown) to the sleepers.

Figure 5:
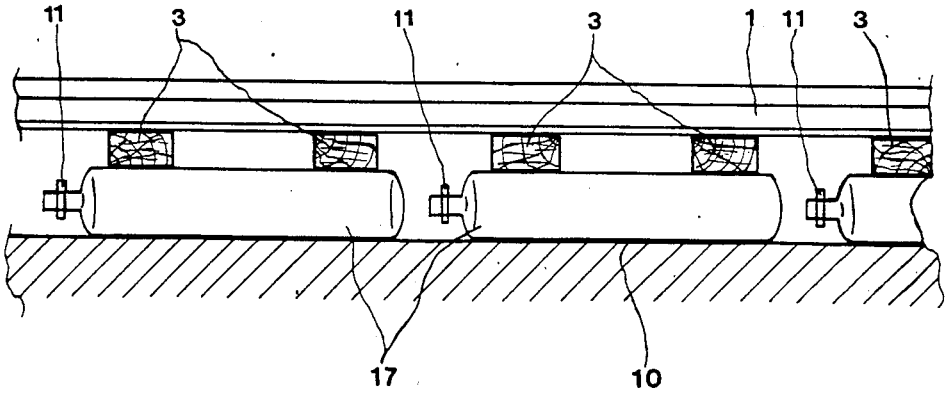
FIG. 5 shows another embodiment.

FIG. 5 shows an embodiment of the railway track according to the invention with the bags 17 extending in longitudinal direction of the rails 1. Each bag 17 has a length such that it extends beneath two sleepers 3. Viewed transverse to the rail 1, the bags must be sufficiently wide to form a stable support of the sleepers 3. Instead of the bags 17 shown in the drawing there may be used far longer bags or "tubes" filled with ballast material. More particularly, said long "tubes" or "sausages" filled with ballast material might have a length of a few dozen meters or about the same length as a rail 1. Also with the embodiment according to FIG. 5 the essential idea is that beneath each sleeper 3 two bags 17 are to be positioned side by side.

It should be added that DE No. 19 14 712 describes a railway track structure of a different design. In said known railway track instead of sleepers use is made of a continuous rigid concrete slab which rests on a rigid ballast bed, which is injected with cement mortar. Further, there is present a plastics encasting which serves as a temporary shuttering for the hard foam to be injected, as a result of which a force transmitting layer is formed between the continuous concrete slab and the ballast bed injected with cement mortar.

Mention should also be made of DE No. 15 34 039, describing a railway track for use in mine tunnels having a very irregularly surfaced bottom. Under the sleepers of said track there are provided waterproof, liquid- or compressed air-filled bags which may be pressurized through a common conduit. The shape of the bags readily adapts itself to the supporting ground surface. For normal overground railway tracks this known system is too vuluerable and too costly. Moreover, of this known structure the stability under dynamic load is insufficient.

Within the scope of the invention various modifications may be made. For instance, instead of using bags of woven material for the supporting elements it is conceivable to employ orificed, thin sheet steel or plastic sheet material, which would have about the same curved shape as the bags and also may be closed with straps or the like.

We claim:

1. A railway track structure formed of at least a pair of rails which are fastened to a plurality of mutually separated sleepers extending in transverse direction of the rails, which are via the sleepers supported on a bed of ballast material, characterized in that each sleeper is supported by and fastened to at least one supporting element comprising a closed bag at least substantially filled with hard ballast material such as pebbles, broken stone and/or sand, which bags mainly form the load-bearing portion of said bed of ballast material.

2. A railway track structure according to claim 1, characterized in that the supporting bags have a flexible wall.

3. A railway track structure according to claim 1, characterized in that the bags are closed and are made of a water-permeable material.

4. A railway track structure according to claim 1, characterized in that the bags are formed of a woven fabric of synthetic yarns, such as those of polyester, polyamide or polypropylene.

5. A railway track structure according to claim 1, characterized in that the bags are each covered internally and/or externally with a web of non-woven material.

6. A railway track structure according to claim 4, characterized in that the tenacity of the fabric is in the range of 90 kN/m to 150 kN/m.

7. A railway track structure according to claim 1, characterized in that the bags are each fastened to the sleepers with one or more straps.

8. A railway track structure according to claim 1, characterized in that the bags filled with ballast material are under tension.

9. A railway track structure according to claim 1, characterized in that the longitudinal direction of the bags filled with ballast material is parallel to the longitudinal direction of the sleepers.

10. A railway track structure according to claim 9, characterized in that the filled bags have a greatest transverse dimension in longitudinal direction of the rails of about 40–70 cm, preferably about 60 cm.

11. A railway track structure according to claim 9, characterized in that measured over their side resting on the subsoil, the filled bags have a length of about 140 to 180 cm, preferably about 150 cm.

12. A railway track structure according to claim 9, characterized in that beneath each sleeper there are positioned two said bags filled with ballast material.

13. A railway track structure according to claim 1, characterized in that the sleepers are each placed inside the upper part of a said bag.

14. A railway track structure according to claim 1, characterized in that the bags are filled with a mixture of said hard ballast material and elastic material, such as pieces of elastomeric material.

15. A railway truck structure as in claim 1, wherein said bag is formed of a woven fabric of polyester yarn.

16. A method of building a railway track structure on a subsoil comprising fastening at least a pair of rails to a plurality of mutually separated individual sleepers extending in transverse direction of the rails, which are via the sleepers supported on a bed of ballast material, characterized in that each sleeper is supported by and fastened to at least one supporting element comprising a closed bag at least substantially filled with hard ballast material such as pebbles, broken stone and/or sand, which bags mainly form the load-bearing portion of said bed of ballast material.

17. A method according to claim 16, characterized in that the sleepers are fastened to the bags by means of straps.

18. A method according to claim 16, characterized in that in the bag filled with ballast material this material is set into vibration for compacting it and the bag is subsequently closed during vibration.

19. A mehtod according to claim 18, characterized in that the ballast material is set into vibration at a frequency and at an amplitude such that the ballast material practically behaves like a liquid, the bag is closed afterwards or during the liquid phase.

20. A method according to claim 16, characterized in that after being filled with ballast material and after being closed by pre-tension transverse to its longitudinal direction, the bag is so compressed that two opposed, practically flat faces are formed.

21. A method according to claim 16, characterized in that a group of individual sleepers, for instance 4–6, with bags filled with ballast material being fastened to them is prefabricated and collectively attached to a carrier, such as a mounting rail, after which the carrier with sleepers and bags is transported to the site for laying the railway track.

22. A method according to claim 16, characterized in that after the bags have been placed on their support, they are covered with ballast material.

* * * * *